US005518313A

United States Patent [19]

McAdam

[11] Patent Number: 5,518,313

[45] Date of Patent: May 21, 1996

[54] GIFT WRAP AND CONTAINER ASSEMBLY

[75] Inventor: Christine A. McAdam, Hermosa Beach, Calif.

[73] Assignee: Indigo Corporation, Bellevue, Wash.

[21] Appl. No.: 222,130

[22] Filed: Apr. 4, 1994

[51] Int. Cl.[6] ..... B65D 33/02; B65D 33/28

[52] U.S. Cl. ..... 383/4; 383/75; 383/76; 383/116; 383/119; 229/87.19

[58] Field of Search ..... 383/4, 76, 104, 383/119, 120, 75, 116; 229/87.02, 87.18, 87.19, 87.01

[56] References Cited

U.S. PATENT DOCUMENTS

| | | | |
|---|---|---|---|
| 461,352 | 10/1891 | Lockwood . | |
| 1,044,023 | 11/1912 | Colgate . | |
| 1,096,537 | 5/1914 | Humphreys | 383/76 X |
| 1,172,204 | 2/1916 | Gerhardstein | 383/4 X |
| 1,404,528 | 1/1922 | Jeffs . | |
| 3,902,541 | 9/1975 | Wardwell . | |
| 4,852,073 | 8/1990 | Wieland | 383/4 |
| 5,092,681 | 3/1992 | Ashley, III | 383/76 X |
| 5,161,895 | 11/1992 | Myers . | |
| 5,273,361 | 12/1993 | Jillson | 383/119 X |

FOREIGN PATENT DOCUMENTS

| | | | |
|---|---|---|---|
| 91438 | 11/1921 | Switzerland | 383/4 |
| 8801593 | 3/1988 | WIPO | 383/76 |

*Primary Examiner*—Jes F. Pascua
*Attorney, Agent, or Firm*—Seed and Berry

[57] ABSTRACT

A flat wrapping container assembly adapted to be folded to form a container having a frame-like support structure disposed therein. The assembly includes a thin, flat sheet of flexible wrapping material and a foldable support structure, which has a center panel and a plurality of outer panels forming frame arms extending outward from the center panel adhered to an inside surface of the sheet. The support structure further has fold lines between the center panel and the outer panels that are adapted to allow the outer panels to pivot upward above the center panel about the fold lines. A pull cord is attached to the flexible wrapping material and to the support structure and is adapted to draw the outer panels and portions of the sheet extending therebetween upward above the center panel when opposite ends of the pull cord are pulled outward away from the center panel, thereby forming a container around an article positioned on the center panel.

46 Claims, 12 Drawing Sheets

GIFT WRAP AND CONTAINER ASSEMBLY

TECHNICAL FIELD

The present invention relates to an assembly used to gift wrap an article, and more particularly, to an assembly that wraps around the article to form a container.

BACKGROUND OF THE INVENTION

Sheets of thin paper have been used to wrap articles in order to form a covering around the article and to, for example, disguise the article. The wrapping paper, however, does not provide a rigid structure around the article, and provides very little protection to the wrapped article. In addition, the process of wrapping the article with the wrapping paper requires the paper to be cut to size, folded around the gift, and taped or otherwise secured closed. This process is labor intensive, time-consuming, and inefficient. As such use of wrapping paper is expensive and sometimes not even practical when a large number of articles must be wrapped or the wrapping must be accomplished in a short time, as is the case for a gift wrapping department of a store, a store sales clerk, or a gift wrapping booth in a shopping mall during a busy holiday season.

Preassembled box structures and collapsible box structures have been used to wrap and contain articles, particularly when rigidity and protection is desired. Preassembled boxes, however, are fairly expensive and cumbersome when wrapping a large number of articles in a short period of time. In addition, a large number of preassembled boxes requires a substantial amount of storage space, which is often not available in gift wrapping booths or retail sales stores. Collapsible boxes require less storage space than the preassembled boxes, but the collapsible boxes must be assembled by a user before being suitable to contain and protect an article placed therein. The assembly process is labor intensive and time consuming, and is not practical or efficient when high volume gift wrapping is required or the wrapping must be accomplished in a very short time.

To avoid the drawbacks of boxes or wrapping paper, paper and plastic bags, which receive articles through an opened mouth of the bag, have been used to wrap and contain articles. However, bags are limited to receiving articles having a cross-sectional area that will pass through the mouth of the bag, so many different sized bags are needed to accommodate a wide variety of different sized articles. In addition, the bags are not aesthetically pleasing and do not provide a rigid structure around the article and provide very little protection for the articles contained therein.

Accordingly, there is a need for an inexpensive assembly that allows articles to be wrapped and contained within a protective structure quickly. There is also a need for an assembly used to wrap and contain an article which takes up a minimum amount of storage space when stored in inventory, is inexpensive to manufacture, and provides a time efficient wrapping process. The assembly should lend itself for use in displaying on a surface thereof advertising, artwork or other printed material of an interesting nature to the user in a readily visible manner.

SUMMARY OF THE INVENTION

The present invention solves the above and other deficiencies of the prior art by providing a flat, support structured, wrapping container assembly that can be stored in a flat, stacked arrangement and then folded upward around an article placed onto the flat assembly by pulling on a pull cord, thereby forming a protective container around the article. In one embodiment of the present invention, the assembly has a flat sheet of flexible wrapping material with a center portion and an outer portion extending about the center portion to form a sheet having a predetermined size and shape. A plurality of apertures extend through the sheet outer portion and are adapted to slideably receive a pull cord. A flat support structure is attached to the sheet and has a center portion and a plurality of outwardly extending portions outward from the center portion, with the support structure center portion positioned over the sheet center portion. The outwardly extending portions of the flat support structure have a plurality of apertures that are sized to slideably receive the pull cord so that the apertures align with a corresponding number of the apertures in the sheet.

The flat support structure of the one embodiment has fold portions positioned between the support structure center portion and the support structure outwardly extending portions that allow the support structure outwardly extending portions to fold upward above the support structure center portion to form a folded support structure with the sheet of flexible wrapping material connected to the support structure center portion and spanning between the support structure outwardly extending portions to form a container.

The pull cord is a flexible pull cord threaded through the apertures in the sheet and in the support structure. The pull cord is adapted to be pulled outward away from the support structure center portion, thereby causing the assembly to fold about the folded portions, and the support structure outwardly extending portions and the sheet to be folded upward with an article positioned on the support structure center portion to form a container around the article.

In a first embodiment of the assembly, the support structure is a one-piece member having the fold portions formed integrally therein, such that the fold portions define the shape of the support structure center portion. In an alternate embodiment of the invention, the support structure center portion and the support structure outwardly extending portions are separate members with a gap therebetween that allows the outwardly extending portions to fold upward above the center portions.

In another alternate embodiment of the invention, pull cord retaining devices, such as flexible tubular members or loops, are secured to the sheet outer portion and are adapted to slideably retain the pull cord therein. As such, the pull cord can slide through the retaining device when the pull cord is pulled outwardly and as the assembly folds upward and forms the container.

In another alternate embodiment of the invention, a second sheet of flexible wrapping material is attached to the first sheet of wrapping material to form a laminated assembly with a pull cord channel formed between the outer portions of the sheets. The pull cord is slideably retained in the channel and exits the channel through an opening formed by an aperture in the sheets. Thus, the pull cord slides through the channel as the pull cord is pulled outwardly to fold the assembly into the container.

In yet another embodiment of the invention, an edge portion of the sheet is folded inward toward the center portion of the sheet and is secured to form a pull cord channel around the sheet. The pull cord is slideably retained in the pull cord channel and exits the channel through an opening in the sheet.

In yet another embodiment of the invention, an inner layer of shock attenuating material is attached to an inner surface of the support structure. The shock attenuating material, such as a plastic laminated layer having a plurality of cushioning air pockets therein, forms a layer that provides protection to an article within the folded container against damage from, the example, an impact to the assembly.

DETAILED DESCRIPTION OF THE INVENTION

Figure 1:
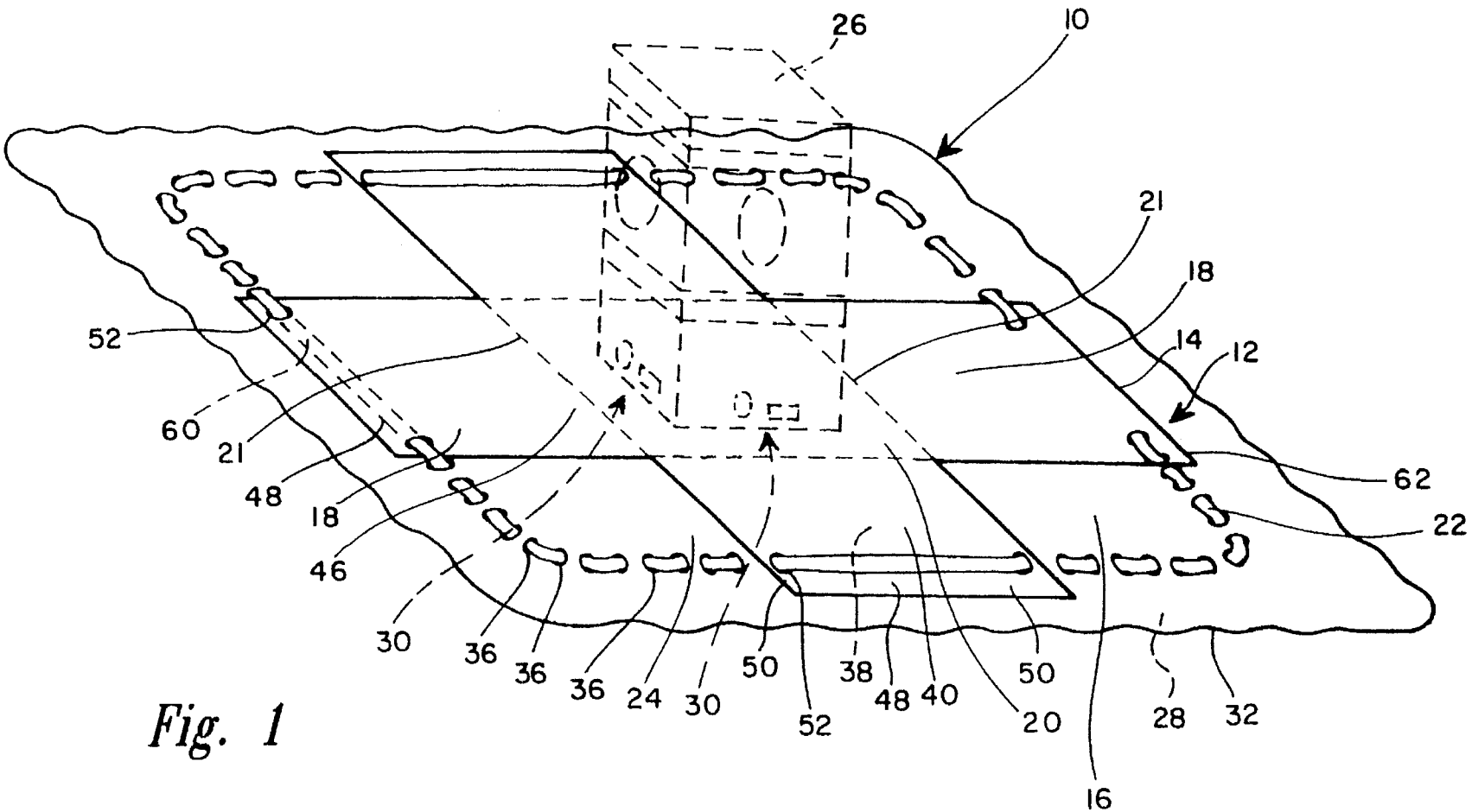
FIG. 1 is a top isometric view of the wrapping container assembly of the present invention in a flat open position with a package shown in phantom line positioned on a center portion of the assembly.
Figure 2:
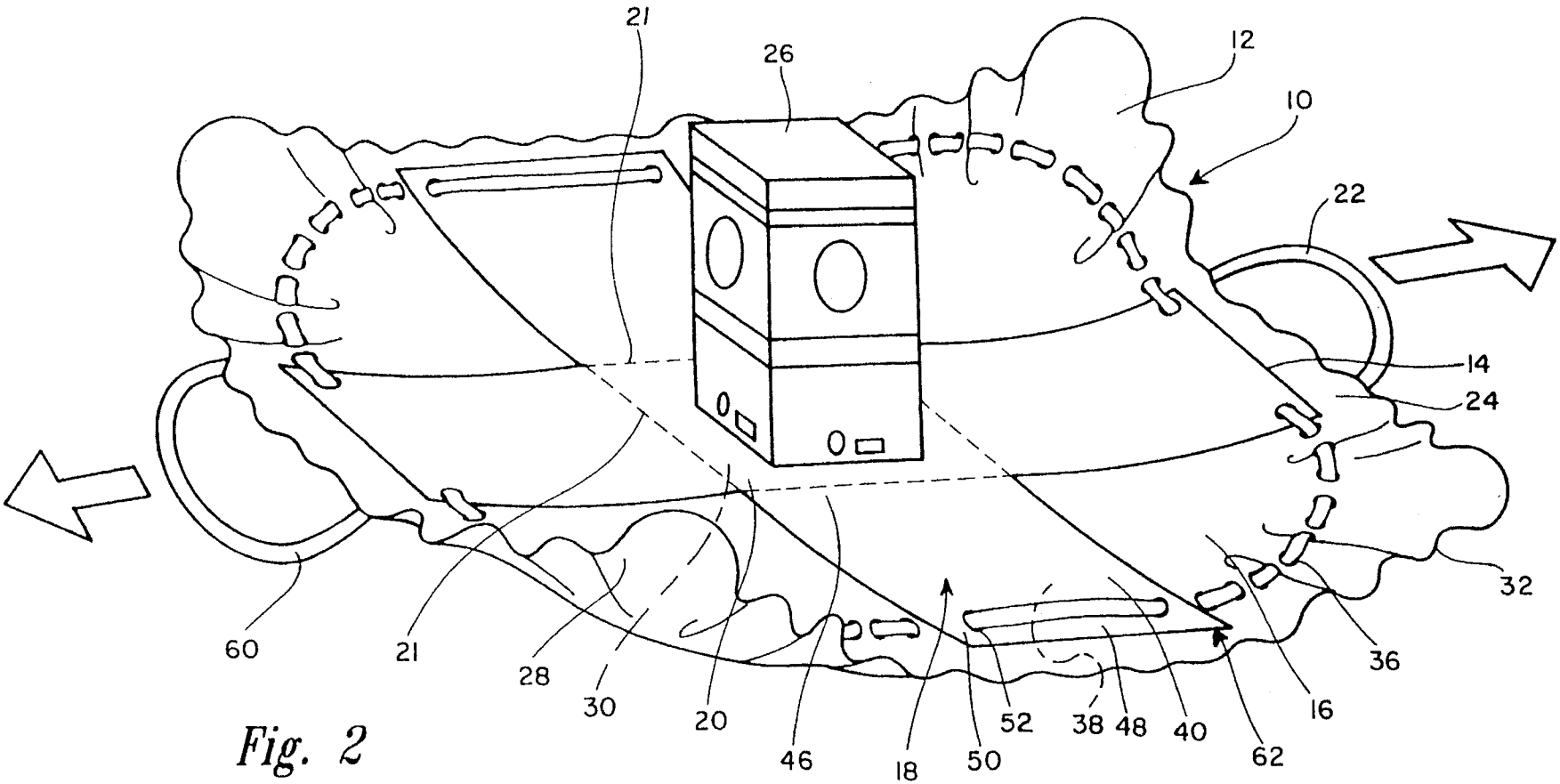
FIG. 2 is a top isometric view of the wrapping container assembly of FIG. 1 shown in an intermediate folded position with the package shown in solid line and a pull cord partially pulled outward away from the center portion.
Figure 3:
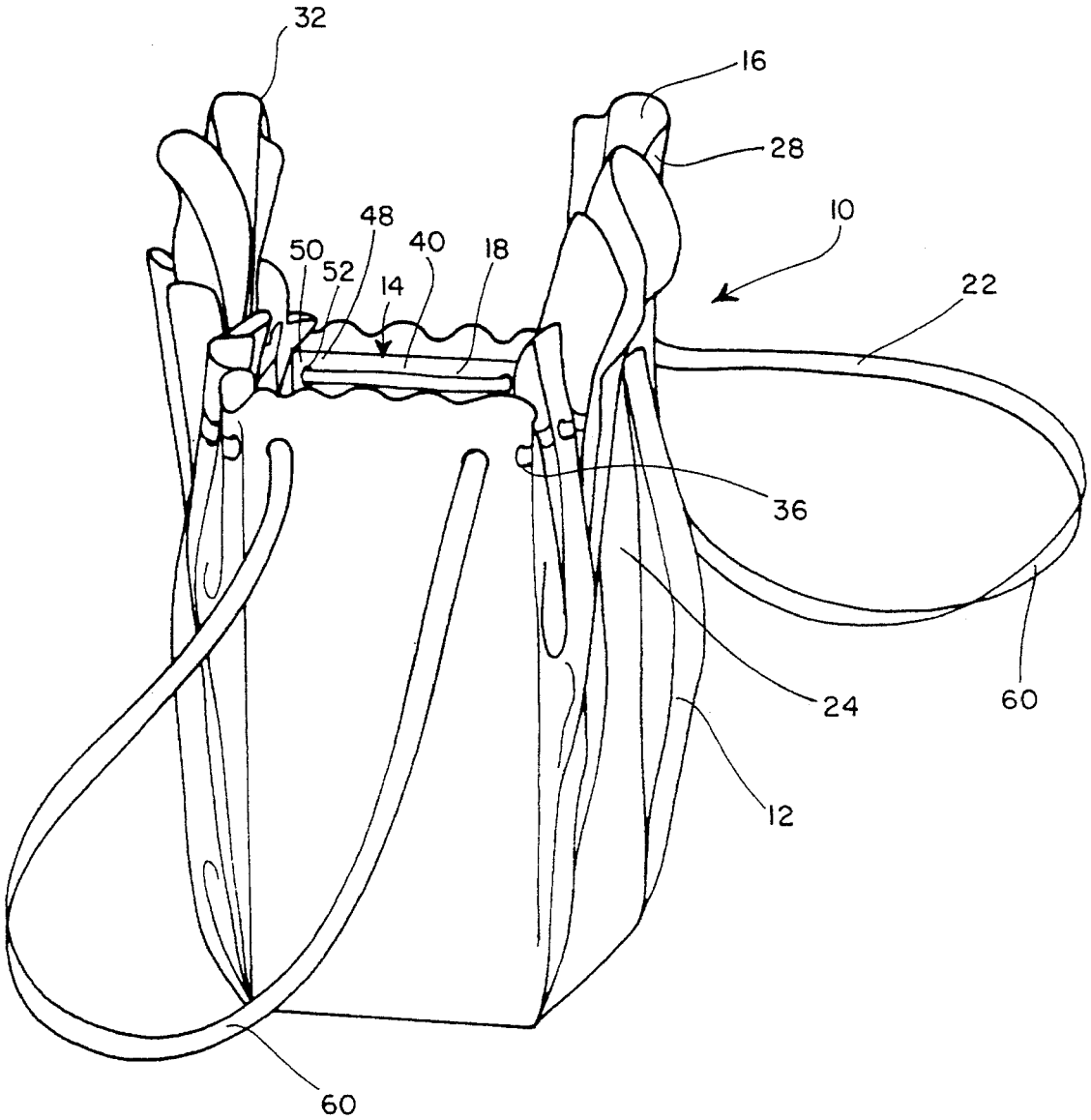
FIG. 3 is an enlarged, top isometric view of the wrapping container assembly of FIG. 1 shown in a closed, folded position with the pull cord forming handles of the folded assembly.

Several preferred embodiments of the present invention are described herein and shown in the attached drawings. As best seen in FIGS. 1, 2, and 3, a flat, support structured, wrapping container assembly 10 has an outer sheet 12 of wrapping material and a flat, inner support structure 14 that is attached to an inside surface 16 of the sheet 12. The sheet 12 is a thin, flexible material, such as paper, plastic, mylar, or the like, and the support structure 14 is a plate of stiffer material, such as cardboard, plastic, fabric, or the like, that has greater rigidity than the sheet 12. The support structure 14 has flat, interior side panels 18 that form frame arms to provide rigidity to the assembly 10, wherein the side panels extend outward away from a center panel 20 of the support structure. The support structure 14 is designed for the side panels 18 to be folded upward about the center panel 20 along fold lines 21, with the side panels forming four substantially flat sides or walls of the container.

A pull cord 22 slideably engages the side panels 18 and an outer portion 24 of the sheet 12, so the pull cord can be pulled outward away from the center panel 20 of the support structure, as seen in FIG. 2. As the pull cord 22 is pulled outward, the side panels 18 and the outer portion 24 of the sheet 12 fold upward about the fold lines 21 from the open, flat position, as shown in FIG. 1, through an intermediate folded position, as shown in FIG. 2, to a closed, folded position as shown in FIG. 3. Accordingly, the assembly 10 is adapted to fold up and around a package 26 or other article, shown in phantom line in FIG. 1 and in solid line in FIG. 2, that is positioned on the center panel 20 of the support structure 14 and to form a container with the package disposed therein by simply pulling outward on the pull cord 22 in one easy motion. In the closed, folded position, an outside surface 28 of the sheet 12 provides an exterior of the assembly 10 and the pull cord 22 forms one or more extended loops that provide handles for carrying the assembly and the package 26 therein as a unit.

Figure 4:
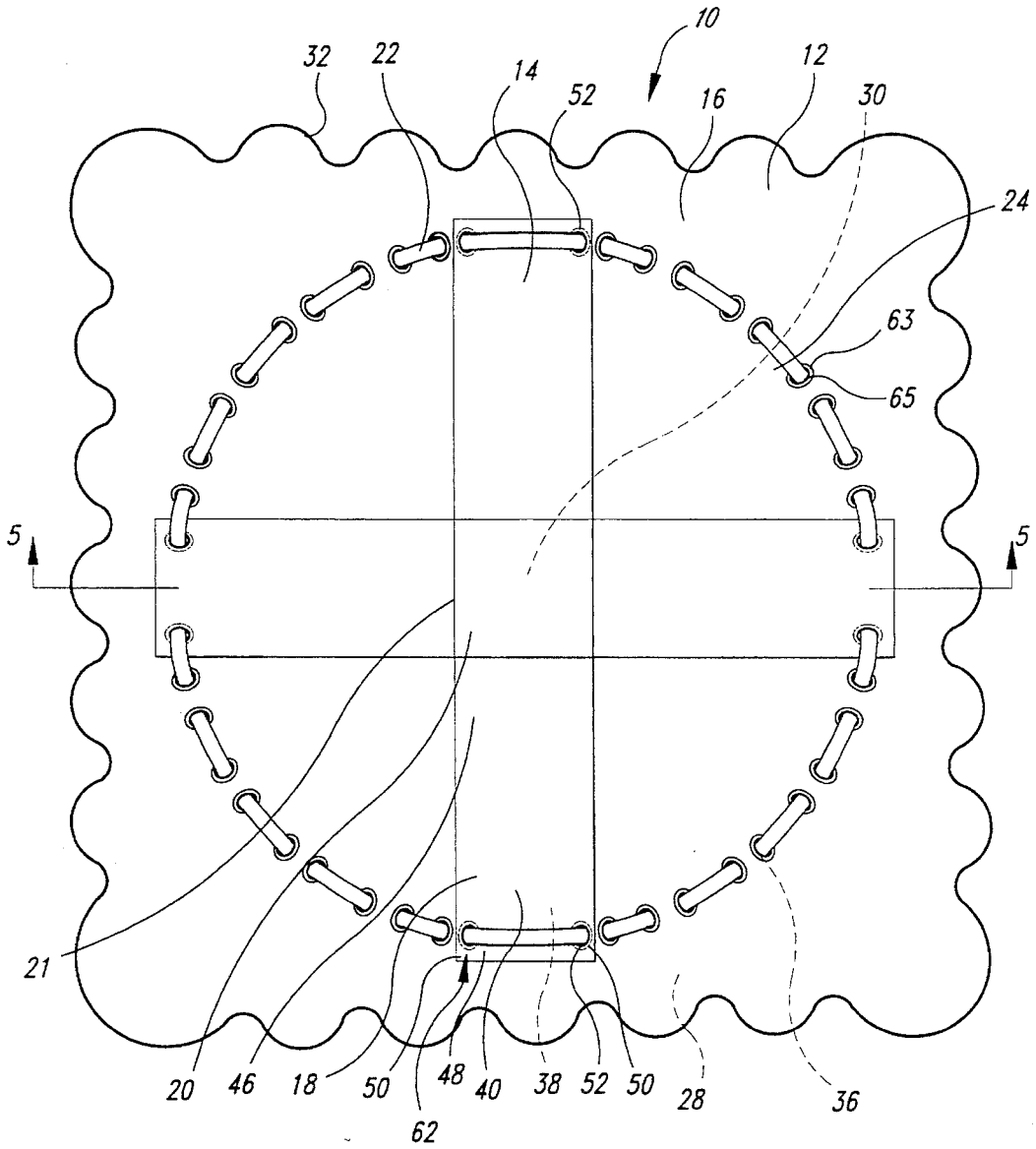
FIG. 4 is a top plan view of a a first alternative embodiment of the wrapping container assembly of the present invention in a flat position with a support structure attached to a flat sheet of wrapping material, a plurality of apertures formed therein in a circular pattern, and a pull cord threaded through the apertures.
Figure 5:
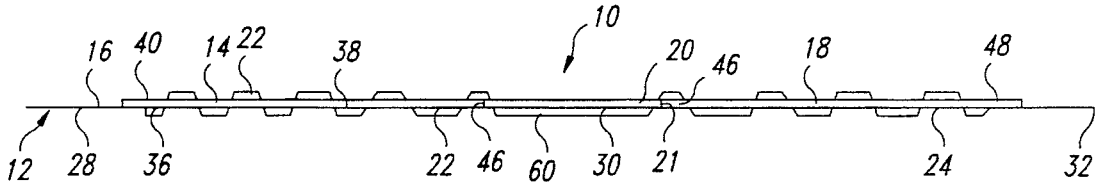
FIG. 5 is a cross-sectional view taken substantially along line 5—5 of FIG. 4.

As best seen in FIG. 1, and for a first alternative embodiment in FIGS. 4 and 5, the outer portion 24 of the sheet 12 extends about a center portion 30 of the sheet that is overlaid by the center panel 20 of the support structure 14. The sheet 12 has edges 32 around the outer portion 24 that are die cut or otherwise shaped to form a substantially square sheet with scalloped edges to provide a decorative top portion of the container when the assembly 10 is in the closed, folded position shown in FIG. 3. Although the sheet 12 of the embodiments of FIGS. 1–5 is substantially square, the sheet may be cut to have different shapes, such as triangular, circular, rectangular or the like, that relate to the desired finished shape of the assembly 10, and also different sizes. The edges 32 can also be cut straight or with different patterns other than being scalloped to provide a desired decorative top portion of the assembly 10.

Figure 6:
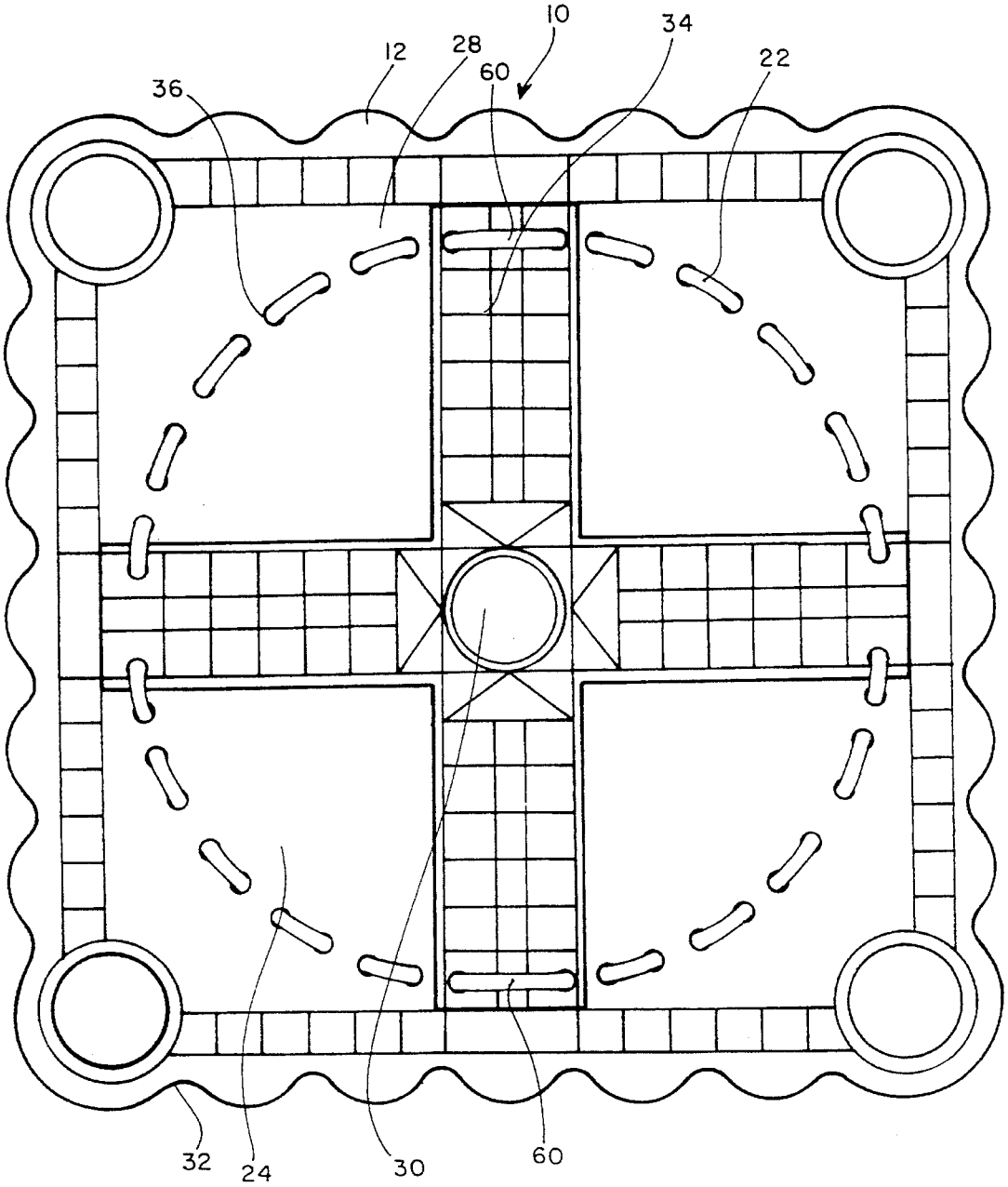
FIG. 6 is a top plan view of the wrapping container assembly of FIG. 4 with markings printed on an inside surface of the sheet.

The outside surface 28 of the sheet 12 of the preferred embodiment has a texture that allows for printing to be adhered thereto so as to provide a decorative and aesthetically pleasing container assembly 10. As best seen in FIG. 6, a second alternate embodiment of the present invention has printing 34 on the inside surface 16 of the sheet 12. When the assembly 10 is folded from the open, flat position to the closed, folded position, the printing 34 is on the interior of the package so as to create an attractive interior. The printing 34 can also be adhered to the outside surface 28 of the sheet, so the printing is on the outside of the package to create a container with an attractive exterior. The printing 34 can be, for example, a game board design that can be used by children when the assembly 10 is moved from the closed, folded position to the open, flat position. Other designs may also be printed on the inside and outside surfaces of the sheet 12 to provide a desirable design on the container.

Since the portion of the sheet 12 overlaid by the side panels 18 is flat, especially if the sheet 12 is adhered to the side panels, the corresponding portion of the outer surface 28 of the sheet provides a flat panel which can carry printed material and remain visible and easily readable even when the assembly 10 is the closed, folded position of FIG. 3. A plurality of apertures 36 extend through the outer portion 24 of the sheet 12 and are arranged in a pattern encircling the center portion 30 of the sheet. The pattern of the embodiment of FIGS. 1–3 is rectangular whereas the pattern of the embodiment of FIGS. 4 and 5 is circular. The apertures 36 are sized to receive the pull cord 22 and allow the pull cord to freely slide therethrough when the pull cord is pulled. Adjacent apertures 36 around the sheet 12 are spaced apart at a distance so the outer portion 24 will told upward and be drawn together uniformly in the areas between the side panels 18 of the support structure 14 when the assembly 10 is moved to the closed, folded position of FIG. 3. Although the apertures 36 in the preferred embodiment are positioned to form rectangular and circular patterns, the apertures can be positioned in any other configuration that allows the outer portion 24 to be drawn together uniformly and the side panels 18 to fold upward when the pull cord 22 is pulled outward.

The support structure 14 is adhered to the sheet 12 with an outside surface 38 of the support structure against the inside surface 16 of the sheet. As such, an inside surface 40 of the support structure 14 faces upward away from the sheet 12 and provides a flat surface that controls the package 26 when it is placed on the assembly, as shown in FIG. 1. The center panel 20 of the support structure 14 is a square center panel that forms a base of the assembly 10 and is sized to receive the package 26 thereon. The side panels 18 of the support structure 14 are formed by four rectangular outer panels that are positioned adjacent to the four sides of the center panel and that extend outwardly away from the center panel toward the edges 32 of the sheet 12. As such, the support structure 14 is a cross shaped structure attached to the sheet 12.

A substantial portion of the side panels 18 are securely attached with an adhesive to four areas of the outer portion 24 of the sheet 12 with the remaining areas of the outer portion spanning between the side panels and extending outward to the edges 32. As such, the side panels 44 of the support structure 14 and the outer portion 24 of the sheet 12 will move upward as a unit to form the container when the assembly 10 is folded from the open, flat position to the closed, folded position. This also forms the flat portions of the outer surface 28 of the sheet 12 which can bear printing readable when the assembly is in the closed, folded position. In the preferred embodiment, the support structure 14 is adhered to the sheet 12 by a conventional glue, although heat sealing, sewing, or the like could be used to join the components.

As best seen in FIG. 4, each of the side panels 18 has an inward portion 46 adjacent to the center panel 20 of the support structure 14 and an outward portion 48 away from the center area. The outward portion 48 includes two outside corner areas 50 with an aperture 52 extending through each. The aperture 52 is shaped and sized to slideably receive the pull cord 22, and is positioned to overlap and align with one of the apertures 36 in the outer portion 24 of the sheet 12. As such, the support structure 14 has a plurality of apertures 52 that are aligned with a corresponding number of apertures 36 in the sheet 12.

Figure 14:
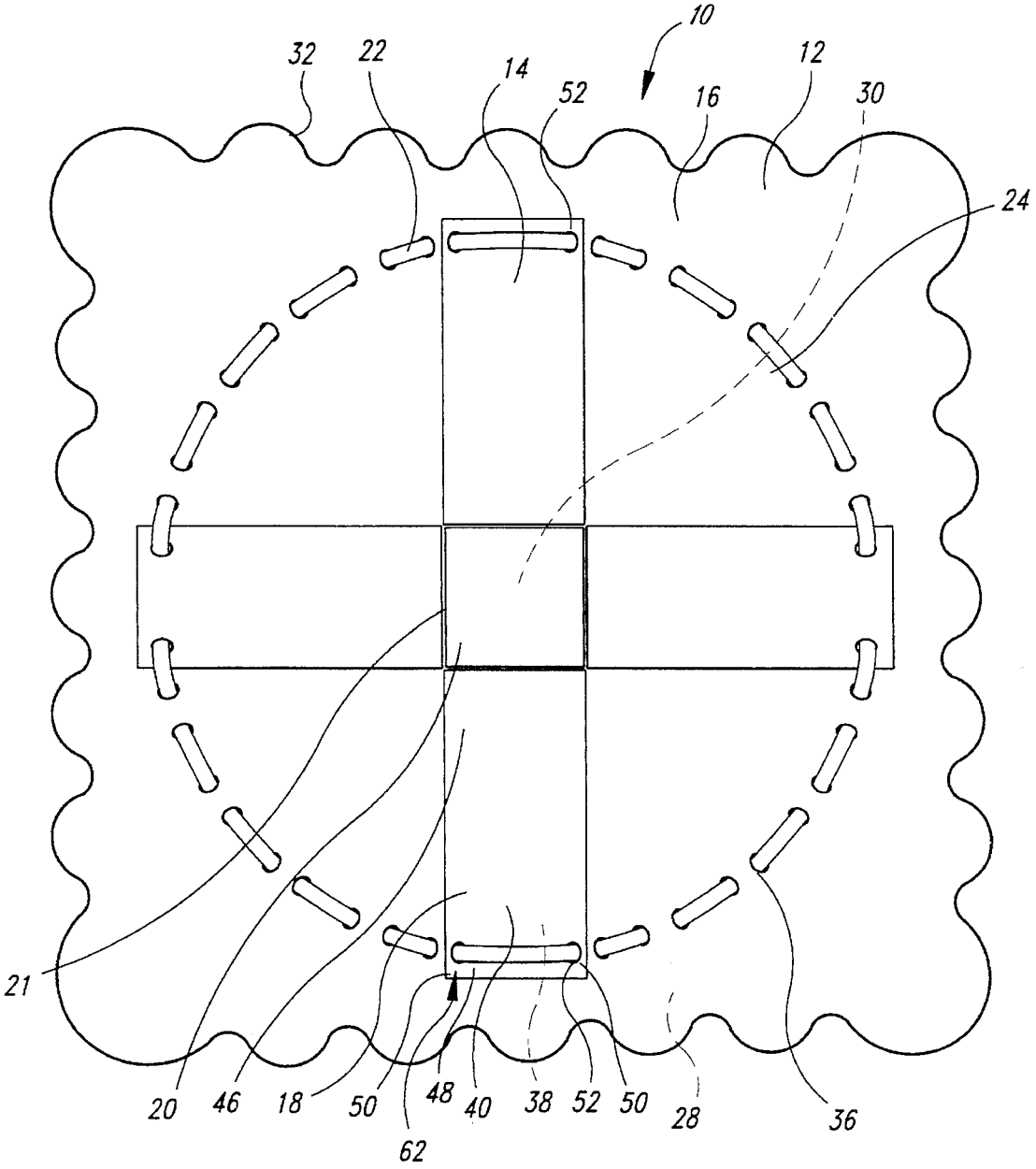
FIG. 14 is a top plan view of a seventh alternate embodiment of the wrapping container assembly of the present invention with the center panel and side panels of the support structure being fabricated as separate pieces.

In the preferred embodiments of the invention, the support structure 14 is formed from a single sheet of rigid material, with the fold lines 21 being die cut lines formed in the one-piece support structure. In an alternate embodiment of the invention illustrated in FIG. 14, the center panel 20 of the support structure 14 and side panels 18 may be fabricated as separate pieces adhered to the sheet 12, with a gap provided between the center panel and each or the side panels. This gap allows the side panels 18 to fold upward above the center panel 20 without interfering with the center panel. A portion of the sheet 12 which extends between the center panel 20 and each of the side panels 18 spanning the gap forms a hinge-like connection to each of the side panels 18, so the stitching will hold the side panels and center panel together and will allow the side panels to fold upward about the center panel. In yet another alternate embodiment of the invention not illustrated, a separate hinge mechanism is secured to the center panel 20 and to the inward portion 46 of each side panel 18.

As best seen in FIG. 4, protection against the pull cord ripping through the material surrounding the apertures 36 is provided by a reinforcing portion 63 attached to the sheet 12 around each of the apertures. The reinforcing portion 63 has an aperture 65 therein that aligns with the aperture 36 in the sheet 12. The reinforcing portion 63 of the preferred embodiment is a spot coating of a tear resistant material, such as plastic or the like adhered to the sheet. Although the spot coating is preferred, the reinforcing portion 63 could be a ring made of plastic, nylon, cloth, or the like that is adhered with conventional adhesives to the sheet 12 so the aperture 65 in the reinforcing ring is coaxially aligned with the aperture 36 in the sheet. In the preferred embodiment, the reinforcing portion 63 is attached to the sheet 12 and the apertures 36 and 65 are then die cut so the resulting apertures in the sheet 12 and the reinforcing portion are perfectly aligned.

Figure 7:
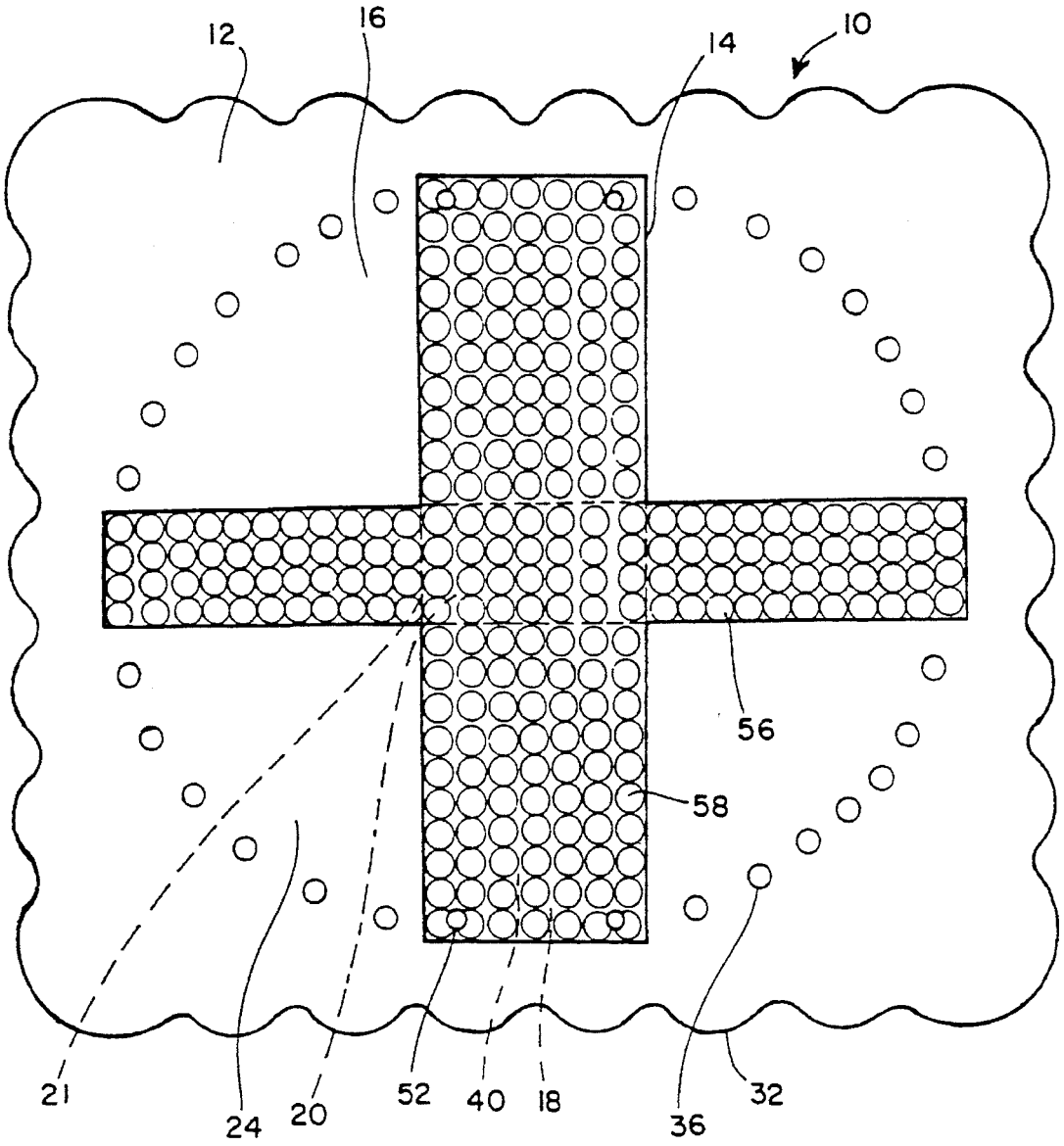
FIG. 7 is a top plan view of a second alternate embodiment of the wrapping container assembly of the present invention with a layer of shock attenuating material secured to an inside surface of a support structure, without a pull cord being shown.

As best seen in FIG. 7, a second alternate embodiment of the present invention has an inner layer 56 of shock attenuating material, such as bubble wrap material, attached to the inside surface 40 of the support structure 14. The bubble wrap layer 56, which is shaped and sized to fully cover the support structure 14, is a plastic layer having a plurality of cushioning air pockets 58 formed therein that will attenuate shock that, for example, is the result of a blow to the exterior of the assembly 10.

The pull cord 22 of the preferred embodiments is a flexible fabric pull cord having two ends connected together to form a continuous loop. The pull cord 22 is threaded through the apertures 36 in the outer portion 24 of the sheet 12 and through the apertures 52 formed in the side panels 18 so as to pass in through one aperture, and out through the next adjacent aperture. The apertures 36 and 52 are arranged so an elongated segment 60 of the pull cord 22 extends along the outside surface 28 of the sheet 12 directly under the outside portions 48 of at least one, but preferably two of the side panels 18 on opposite sides of the center panel 20 of the support structure 14 when in the open, flat position, such as shown in FIG. 1. The elongated pull cord segments 60 are longer than segments of the pull cord extending between the other adjacent apertures 36 in the sheet 12 that are not aligned with the apertures 52 in the side panels 18. The elongated pull cord segments 60 provide handle portions that can be easily grasped by a user and pulled outward away from the center panel 20, as shown in FIG. 2, thereby causing the assembly 10 to move toward the closed, folded position of FIG. 3. Although the pull cord 22 of the preferred embodiment is a fabric cord, the pull cord could be made of other materials, such as plastic or the like, that can be threaded through the apertures 36 and 52 and that has sufficient tensile strength to support the assembly 10 with the package 26 disposed therein.

Portions of the sheet 12 and side panels 18 around the coinciding apertures 36 and 52 are adhered together to provide a two-layer laminated area 62 that has a sheer strength greater than the sheer strength of either the sheet or the side panels alone. The two layer-laminated area 62 allows the assembly 10, when it is in the closed, folded position with the package 26 therein, to be carried by the extended loops of the pull cord 22, as shown in FIG. 3, without the pull cord ripping through the material surrounding the apertures 36 and 52.

Figure 8:
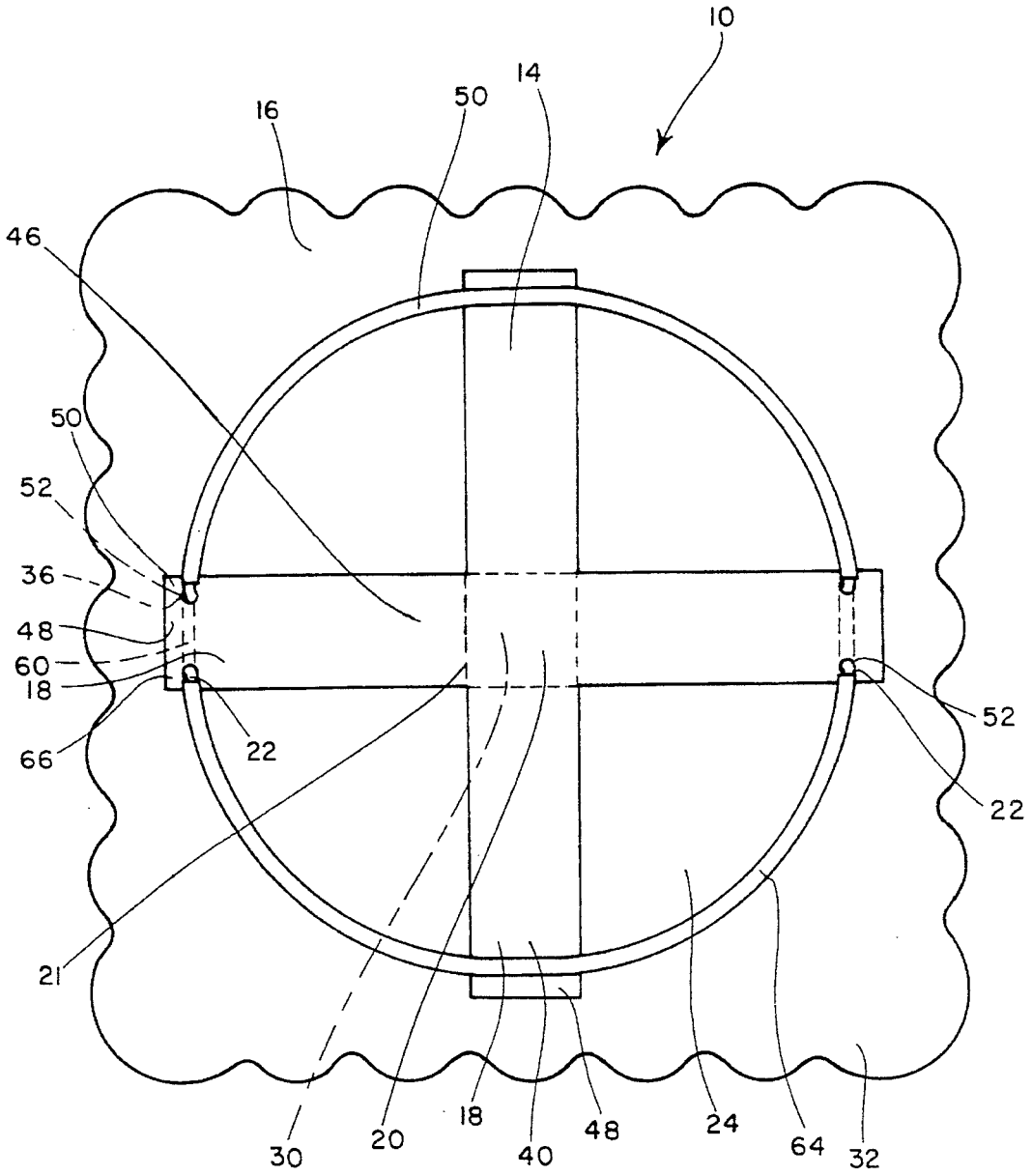
FIG. 8 is a top plan view of a third alternate embodiment of the wrapping container assembly of the present invention with a pull cord slideably retained by a tubular member attached to an inside surface of a sheet of wrapping material.

A third alternate embodiment of the present invention is shown in FIG. 8 and has two thin, flexible tubes 64 attached to the outer portion 24 of the sheet 12 along its inside surface 16 and to the outward portion 48 of at least two of the side panels 18 along their inside surfaces 40. The tubes 64 slideably receive the pull cord 22 therein and retain the pull cord around the outer portion 24 of the sheet 12. In this embodiment, the support structure 14 only has four apertures 52, two apertures being through the outward portions 48 of each of side panels 18 which extend outward away from the center panel 20 in opposite directions. The tubes extend across and are adhered to the other side panels 18 that do not have apertures therein. In this manner, the sheet 12 need only have four apertures 36, wherein each aperture in the sheet aligns with a different one of the four apertures 52 in the side panels 18.

Each of the tubes 64 is arranged in a semi-circular pattern around the outer portion 24 of the sheet 12. As such, the two tubes 64 together form a substantially circular pattern around the sheet 12 and the support structure 14. Each of the tubes 64 has two open ends 66 with each of the open ends being positioned adjacent to different ones of the apertures 52 in the side panels 18. The pull cord 22 exits the tubes 64 through their open ends 66, passes through the coinciding apertures 36 and 52, and extends across the outer surface of the sheet 12 to form the elongated pull cord segment 60.

The tubes 64 are sufficiently thin and flexible so that when the pull cord 22 is pulled outward and the assembly moves to the closed, folded position, the tubes will buckle as the side panels 18 are folded upward and the outer portion 24 of the sheet 12 between the side panels is gathered together. The portions of the tubes 64 that extend across the two side panels 18 without apertures formed therein are glued or otherwise adhered to the outward portion 48 of the side panels, so the two side panels will also be drawn upward above the center panel 20 when the pull cord 22 is pulled outward away from the center panel. The portions of the tubes 64 that extend along the outer portion 24 of the sheet 12 are adhered thereto by gluing the tubes at intermittent locations to the sheet. The tubes 64, however, could also be secured to the sheet by heat sealing, sewing, or the like. Although this embodiment uses only two tubes 64 arranged in a circular pattern, a greater number of tubes having shorter lengths can be used to form a plurality of pull cord receiving members positioned around the outer portion 24 of the sheet 12.

Figure 9:
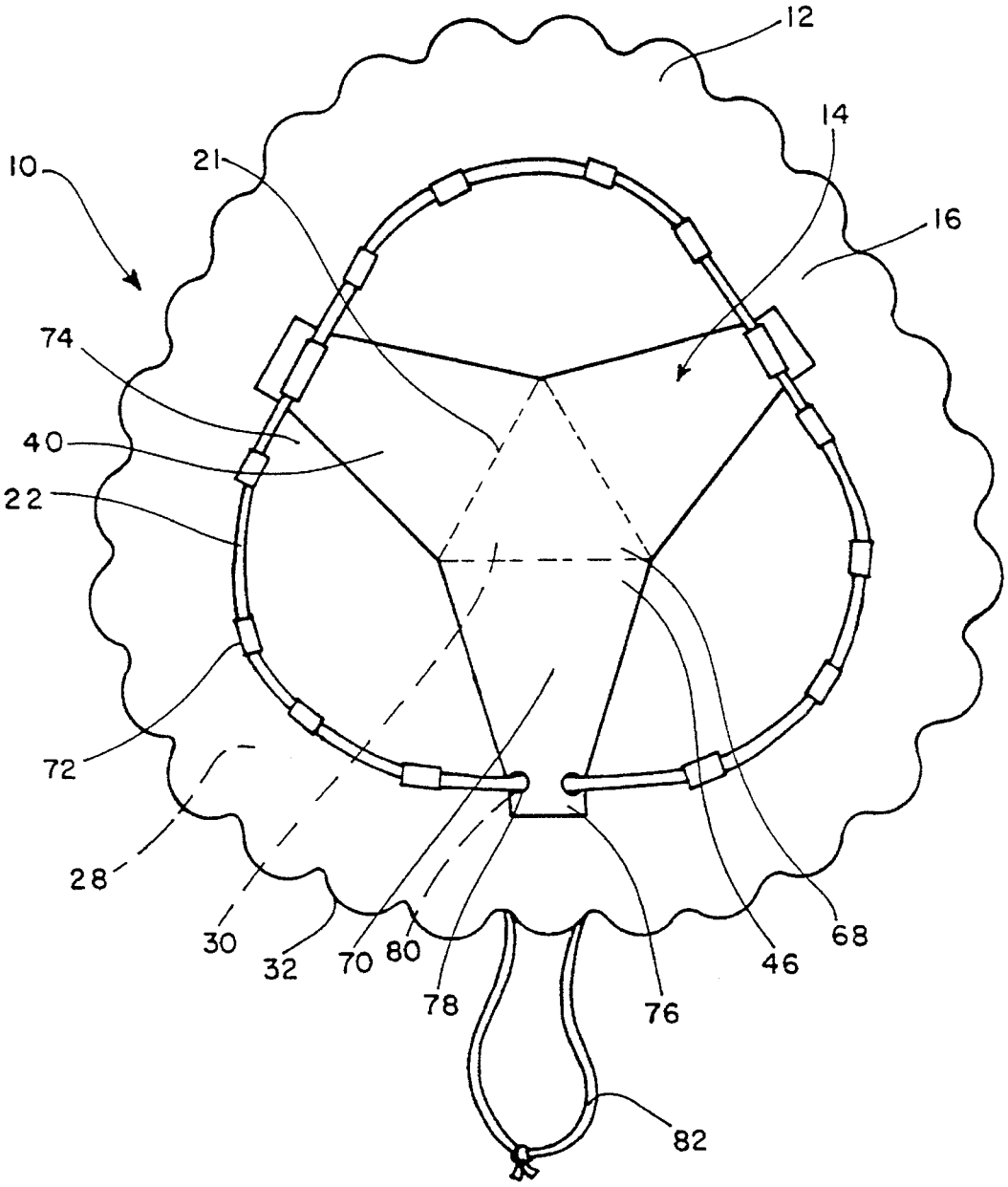
FIG. 9 is a top plan view of a fourth alternate embodiment of the wrapping container assembly of the present invention having a triangular shape support structure with a pull cord slideably retained by a plurality of loops attached to an inside surface of a sheet of wrapping material and to an inside surface of the support structure.

Such an arrangement is shown in FIG. 9 as a fourth alternate embodiment of the present invention. The sheet 12 is cut in a generally triangular shape. The support structure 14, which is adhered to the sheet 12 in the manner discussed above, has a substantially triangular shape with a triangular center panel 68 and three side panels 70 that extend outward in three directions away from the center panel. Each of the side panels 70 tapers from wide to narrow as it extends outward away from the triangular center panel 68. In addition, the support structure 14 has three fold lines 54 positioned between the center panel 68 and the side panels 70, as discussed above. As such, the side panels 70 can fold upward above the center panel 68 to create a triangular shaped container assembly.

The pull cord 22 of the assembly 10 of FIG. 9 has two ends tied together to form a continuous loop. The pull cord 22 is slideably attached to the sheet 12 and to the side panels 70 by a plurality of loops 72 that are adhered to an outer portion 74 of the sheet and to outsized portions 76 of two of the three side panels 70. The third side panel 70 has two apertures 78 extending therethrough that are sized to slideably receive the pull cord 22 and that are positioned to align with two similarly sized apertures 80 in the outer portion 74 of the sheet 12. The pull cord 22 extends through the loops 72, extends outward through the coinciding apertures 78 and 80, and forms an extended handle portion 82 that a user can grasp. The handle portion 82 allows the user to pull the pull cord 22 outward away from the center panel 68, thereby moving the assembly 10 from an open flat position shown in FIG. 8 to a folded, closed position similar to that shown in FIG. 3 for another embodiment.

Figure 11:
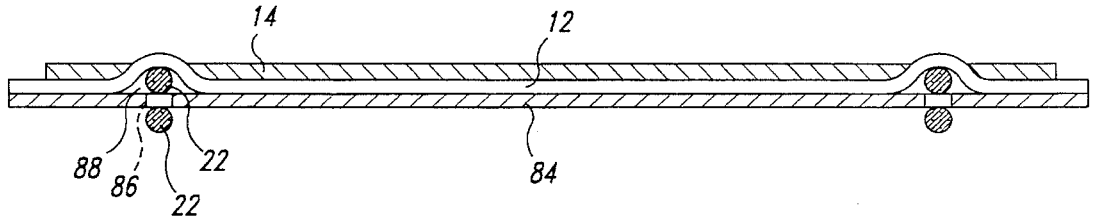
FIG. 11 is a reduced cross-sectional view taken substantially along line 11—11 of FIG. 10.
Figure 10:
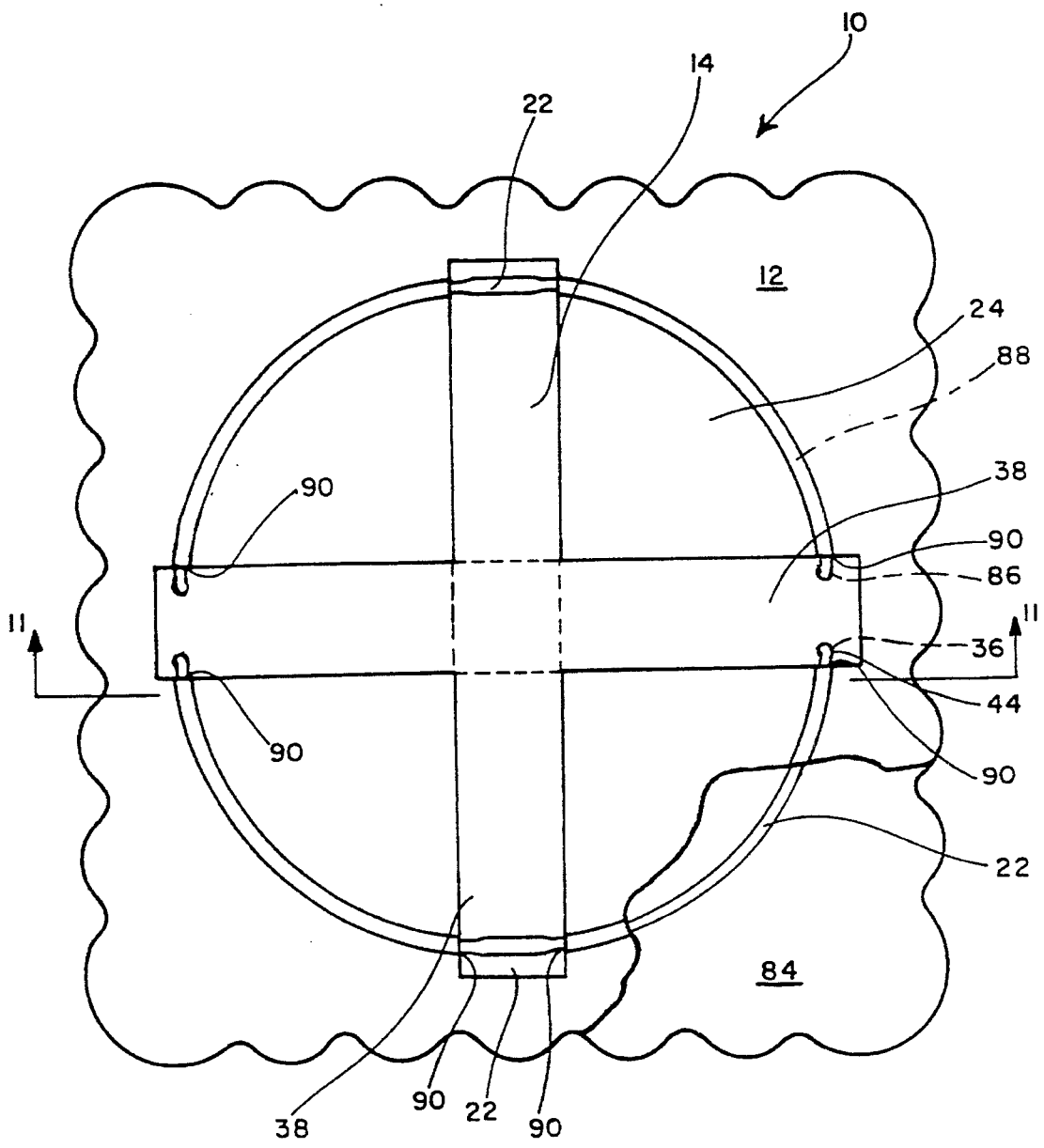
FIG. 10 is a top plan view of a fifth alternate embodiment of the wrapping container assembly of the present invention with the pull cord slideably retained in a channel formed between two sheets of wrapping material, with a portion of one sheet being cut away.

A fifth alternate embodiment of the present invention is shown in FIGS. 10 and 11 and has an outside sheet 84 of flexible wrapping material attached to the outside surface 28 of the sheet 12, so the sheet 12 is an inside sheet. As such, the outside and inside sheets 84 and 12 form a laminated sheet assembly. The outside sheet 84 has approximately the same size and shape as the inside sheet 12 and has apertures 86 therethrough that are aligned with a corresponding number of the apertures 36 in the inside sheet. The inside and outside sheets 12 and 84 are adhered together to form a channel 88 between the two sheets around the outer portion of the inside sheet. The channel 88 slideably retains the pull cord 22, and the pull cord exits the channel through at least one opening formed by one of the apertures 86 in the outside sheet. Accordingly, the pull cord 22 is movably sandwiched between the inside and outside sheets 12 and 84 and extends through the outside sheet, so the pull cord is accessible to a user to grasp and pull outward to fold the assembly upward into a container.

The outside sheet 84 is a thin flexible material, such as paper, plastic, mylar or the like. The outside sheet is adhered to the inside sheet 12 with a conventional adhesive, although other methods of attaching two layers together, such as heat sealing, could be used.

The pull cord 22 extends across a portion of the outside sheet 84 so as to be accessible to a user to hold while pulling outwardly on the pull cord. As seen in the illustrated embodiment shown in FIG. 10, the inside sheet 12 has a pair of apertures 90 in the outer portion 24 adjacent to each of the outer panels 38 with the outer panels being positioned between the pair of apertures. At two of the outer panels 38 that are opposite each other and that have apertures 44 therein, the pull cord exits the channel 88 through each of the pair of apertures 90 and extends over a portion of the outer panel 38. The pull cord 22 is threaded through the aperture 44 in the outer portion 38 and through the aligned apertures 36 and 86 in the inside and the outside sheets 12 and 84. Accordingly, the pull cord extends between the apertures 86 in the outside sheet 84 such that a user can grasp the pull cord.

Figure 13:
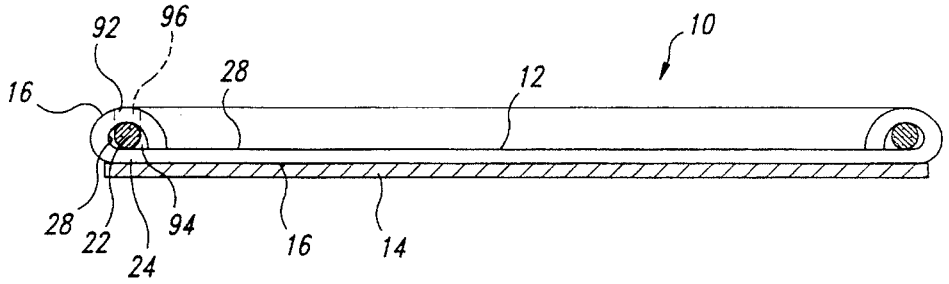
FIG. 13 is a reduced cross-sectional view taken substantially along line 13—13 of FIG. 12.
Figure 12:
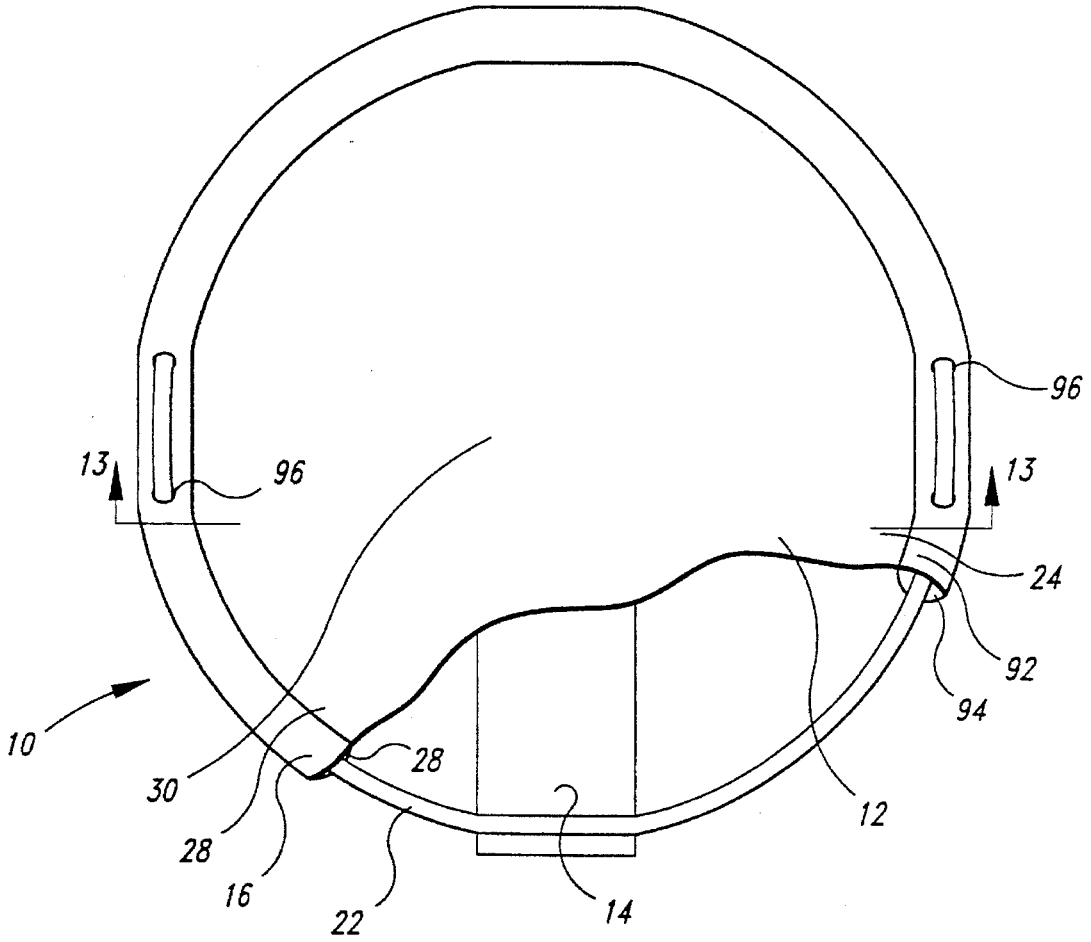
FIG. 12 is a bottom plan view of a sixth alternate embodiment of the wrapping container assembly of the present invention with the pull cord slideably retained in a channel formed by an edge of the sheet folded over and attached to the sheet, with a portion of the sheet being cut away.

In a sixth embodiment of the present invention illustrated in FIGS. 12 and 13, the assembly 10 has one sheet 12 of flexible wrapping material, and the outer portion 24 of the sheet 12 has an edge portion 92 that is folded inward toward the center portion 30 of the sheet and attached to itself so a perimeter channel 94 is formed around the sheet. The edge portion 92 is folded so that the outside surface 28 of the sheet 12 is within the interior of the channel 94, and the inside surface 16 of the sheet is exterior of the channel. The pull cord 22 is slideably retained within the channel 94 and extends outward through the apertures 96 in the edge portion 92 which provide openings in the channel 94 for the pull cord. The edge portion 92 is adhered using a conventional adhesive, although other suitable methods of attachment, such as heat sealing, could be used. Although the embodiment shown in FIGS. 12 and 13 has the outside surface 28 of the sheet 12 within of the channel 94, the sheet could be folded with the outside surface 28 exterior of the channel and the inside surface 16 within the channel.

As best seen in FIG. 12, the sheet has a pair of apertures 96 on opposite sides of the sheet so the apertures are adjacent to each other, with the pull cord 22 extending out of the channel through one of the apertures of the pair, along a segment of the edge portion 92, and into the channel through the adjacent aperture of the pair. Accordingly, the pull cord 22 is accessible to a user on opposite sides of the sheet 12.

Although the illustrated sixth embodiment has a plurality of apertures 96 in the edge portion 92, the edge portion can have only one aperture that forms a single opening in the channel, such that the pull cord will exit the channel through the aperture forming a loop or handle, and entering the channel through the same aperture. The apertures 96 can also be formed in the outer portion 24 of the sheet, so the pull cord exits the channel and extends across a portion of the inside surface 16 of the sheet 12.

In another alternate embodiment of the invention not illustrated, the sheet and the support structure can be formed without apertures formed therein, and with the thin flexible tubes or loops discussed above adhered to the outside surface of the sheet with the pull cord retained therein. In this embodiment, the pull cord is exposed along a short length to provide a handle area that a user can grasp. The tubes or loops will define a top area of the container when the pull cord is pulled outward away from the center panel. The outer portion of the sheet outward of the tubes or loops will form a decorative ruffled top area of the container.

The flat wrapping container assembly 10 of the present invention is designed so that a plurality of the assemblies, when in the open, flat position of FIG. 1, can be stacked vertically with the inside surface 16 of the sheet and support structure 14 of each of the assemblies facing upward. In this manner, the package 26 may be wrapped in a quick and efficient manner by placing the package on the center panel 20 of the top assembly of the stack, grasping the elongated segments 60 of the pull cord 22 on opposite sides of the assembly, pulling the pull cord outward away from the center panel in one continuous motion while lifting upward on the pull cord. As a result, the assembly 10 folds upward from the flat, open position of FIG. 1 to the folded, closed position of FIG. 3 to form the container around the package 26 or other article positioned on the center panel 20 in a fraction of a second with little effort and skill. In the same continuous motion, the pull cord 22 can be lifted upward after the container has been formed so the assembly 10 is lifted off of the stack of assemblies, thereby exposing the next flat assembly that is immediately ready to receive and wrap another package. Accordingly, a package may be wrapped in the decorative container assembly 10 in a very short time with a minimum amount of physical movement by a person wrapping the package and with a minimum of skill.

Numerous modifications and variations of the wrapping and container assembly disclosed herein will occur to those skilled in the art in view of this disclosure. For example, the pull cord may be retained to the outer portions of the sheet and support structure by a channel formed within the sheet and exiting the channel adjacent to the apertures in the support structure. An additional modification could be a support structure having one or more fold portions formed in the side panels to provide an assembly that can fold at multiple fold lines. Therefore, it is to be understood that these modifications and variations, and equivalents thereof, may be practiced while remaining within the spirit and the scope of the invention as defined by the following claims.

I claim:

1. An assembly used to form a wrapping container for holding an article, comprising:

a flat sheet of flexible wrapping material having a sheet center portion and a plurality of sheet outer portions extending about said sheet center portion, and a plurality of sheet interstitial portions extending between said sheet outer portions, said sheet having a sheet inside surface and a sheet outside surface, said sheet further having a plurality of sheet apertures extending through said sheet outer portion;

a flat support structure having a center portion sized to receive the article thereon and a plurality of outer portions extending outward from said support structure center portion, adjacent ones of said plurality of outer portions having an interstitial space therebetween, said support structure having an inside surface and an outside surface, said outside surface of said support structure outer portions being positioned adjacent to said sheet inside surface with said support structure center portion being positioned over said sheet center portion, and said support structure outer portions being positioned over said sheet outer portions with said sheet interstitial portions extending between support structure outer portions across said interstitial spaces, said sheet interstitial portions being out of contact with said flat support structure, said support structure having a plurality of apertures extending through at least one of said support structure outer portions and positioned to align with a corresponding number of said sheet apertures, said support structure further having a fold portion positioned between said support structure center portion and each of said support structure outer portions to allow said support structure outer portions to fold upward above said support structure center portion with said sheet of wrapping material disposed around said folded support structure outer portions to form the container; and a flexible pull cord threaded through said apertures in said sheet of wrapping material and through said apertures in said support structure outer portions, said pull cord being adapted to be pulled outward from said support structure center portion to fold said support structure outer portions upward about said center portion, whereby said support structure outer portions and sheet outer portions can be folded upward as an integral unit with the article in position on the support structure center portion to form the wrapping container around the articles, and said sheet interstitial portions can be gathered between said support structure outer portions as said support structure outer portions are folded upward.

2. The wrapping container assembly of claim 1 wherein said support structure outer portions are adhered to said sheet outer portion to form a flat side portion of the container when said support structure and sheet outer portions are folded to form the container.

3. The wrapping container assembly of claim 1, further including at least one tubular member secured to said sheet outer portion, said tubular member having an interior passageway that slideably receives said pull cord therein.

4. The wrapping container assembly of claim 3 wherein said tubular member has two open ends, each of said open ends being positioned adjacent to one of said apertures in said support structure outer portions, and said pull cord exiting said tubular member through said open ends and passing through said apertures in said support structure outer portions.

5. The wrapping container assembly of claim 4 wherein said tubular member includes two tubes arranged in a circular pattern.

6. The wrapping container assembly of claim 1, further including a plurality of loops attached to said sheet outer portion, said plurality of loops each having an interior passageway that slideably receives said pull cord therein.

7. The wrapping container assembly of claim 6 wherein said plurality of loops are arranged in a circular pattern.

8. The wrapping container assembly of claim 1, further comprising a second sheet of flexible wrapping material attached to said first sheet outside surface, said second sheet having a second sheet center portion and a second sheet outer portion extending about said second sheet center portion, said second sheet further having a plurality of apertures extending through said second sheet outer portion and each positioned to align with one of said apertures in said first sheet, said first and second sheets being attached to form a channel therebetween, said channel having an opening that communicates with at least one of said apertures in said second sheet, said pull cord being slideably retain in said channel and extending through at least one of said apertures in said second sheet.

9. The wrapping container assembly of claim 8 wherein said first sheet and said second sheet are adhered together to form laminated sheet assembly.

10. The wrapping container assembly of claim 8 wherein one of said support structure outer portions is positioned adjacent to a pair of said apertures in said outer portion of said first sheet, with said pull cord extending through each aperture of said pair of apertures and across at least a portion of said outer portion.

11. The wrapping container assembly of claim 1 wherein said sheet outer portion has an edge portion, said edge portion being folded back towards said center portion and attached to a portion of said outer portion inward of said edge portion so a channel is formed around said sheet, said channel having an opening formed by at least one of said apertures in said outer sheet, said pull chord being slideably disposed in said channel and extending through said opening.

12. The wrapping container assembly of claim 11 wherein said edge portion is folded to place said inside surface of said sheet within said channel and said outside surface of said sheet exterior of said channel.

13. The wrapping container assembly of claim 11 wherein said edge portion is adhered to said portion of said outer portion inward of said edge portion.

14. The wrapping container assembly of claim 1 wherein said sheet has graphics thereon.

15. The wrapping container assembly of claim 1 wherein said sheet of wrapping material is plastic.

16. The wrapping container assembly of claim 1 wherein said support structure is a rigid material that forms a base and walls of the container.

17. The wrapping container assembly of claim 1 wherein said support structure has sufficiently greater rigidity than the sheet of wrapping material so said support structure will maintain the shape of the container after the pull cord has been pulled and the support structure outer portions have folded upward.

18. The wrapping container assembly of claim 17 wherein said support structure is cardboard.

19. The wrapping container assembly of claim 1 wherein said support structure is a one piece member with said support structure center portion formed integral with each of said support structure outer portions, each of said fold portions having a fold line formed therein between said support structure center and outer portions, said support structure being adapted to fold at said fold line when said support structure outer portions fold upward.

20. The wrapping container assembly of claim 1 wherein said support structure has a shock attenuating layer secured to said support structure inside surface.

21. An assembly used to form a wrapping container for holding an article, comprising;

a flat sheet of flexible wrapping material having a center portion and a plurality of outer portions extending about said center portion, and a plurality of interstitial portions extending between said outer portions, said sheet having an inside surface and an outside surface, said sheet of flexible wrapping material further having a plurality of apertures therein;

a flat support structure having a center portion, a plurality of outer portions extending outward from said center portion, adjacent ones of said plurality of outer portions having an interstitial space therebetween, said support structure having an inside surface and an outside surface, said support structure being positioned adjacent to said sheet inside surface with said support structure center portion being positioned over said sheet center portion, and said support structure outer portions being positioned over said sheet outer portions with said interstitial portions extending between support structure outer portions across said interstitial spaces, said interstitial portions being out of contact with said flat support structure, said support structure having a plurality of apertures extending through said support structure outer portions, said support structure apertures being aligned with a corresponding number of sheet apertures, each of said support structure outer portions being pivotable relative to said support structure center portion so said support structure outer portions and said sheet outer portions can pivot upward to form the container; and a flexible pull cord threaded through said sheet apertures and through said support structure apertures, said pull cord being adapted to be pulled outwardly from said support structure center portion to pivot said support structure outer portions upwardly above said support structure center portion, and said interstitial portions can be gathered between said support structure outer portions as said support structure outer portions are folded upward.

22. The wrapping container assembly of claim 21 wherein said support structure outer portions being separate members out of contact with said support structure center portion.

23. The wrapping container assembly of claim 22 wherein said support structure center portion and each of said support structure outer portions are spaced apart to define a gap therebetween, and said sheet having a portion spanning said gap to form a pivot area about which said support structure outer portion pivots upward above said support structure center portion.

24. The wrapping container assembly of claim 21 wherein a substantial portion of said support structure outer portions are adhered to said sheet outer portion to form a flat side portion of the container when said support structure and sheet outer portions are pivoted upward to form the container.

25. The wrapping container assembly of claim 21, further including at least one tubular member secured to said sheet outer portion, said tubular member having an interior passageway that slideably receives said pull cord therein.

26. The wrapping container assembly of claim 25 wherein said tubular member has two open ends, each of said open ends being positioned adjacent to one of said support structure apertures, and said pull cord exiting said tubular member through said open ends and passing through said sheet apertures.

27. The wrapping container assembly of claim 21, further including a plurality of loops attached to said sheet outer portion, said plurality of loops each having an interior passageway that slideably receives said pull cord therein.

28. The wrapping container assembly of claim 21, further comprising a second sheet of flexible wrapping material attached to said first sheet outside surface, said second sheet having a second sheet center portion and a second sheet outer portion extending about said second sheet center portion, said second sheet further having at least one aperture extending through said second sheet outer portion and aligned with one of said apertures in said first sheet, said first and second sheets being attached to form a channel therebetween, said channel having an opening formed by said aperture in said second sheet, said pull cord being slideably retained in said channel and extending through said aperture in said second sheet.

29. The wrapping container assembly of claim 28 wherein said first sheet and said second sheet are adhered together to form laminated sheet assembly.

30. The wrapping container assembly of claim 28 wherein one of said support structure outer portions is positioned adjacent to a pair of said apertures in said outer portion of said first sheet, with said pull cord extending through each aperture of said pair of apertures and across at least a portion of said outer portion.

31. The wrapping container assembly of claim 21 wherein said sheet outer portion has an edge portion, said edge portion being being folded back towards said center portion and attached to a portion of said outer portion inward of said edge portion so a channel is formed around said sheet, said channel having an opening formed by at least one of said apertures in said outer sheet, said pull chord being slideably disposed in said channel and extending through said opening.

32. The wrapping container assembly of claim 21 wherein said edge portion is adhered to said portion of said outer portion inward of said edge portion.

33. The wrapping container assembly of claim 21 wherein said sheet has graphics thereon.

34. The wrapping container assembly of claim 21 wherein said sheet of wrapping material is a material selected from the group of plastic, nylon, and paper.

35. The wrapping container assembly of claim 21 wherein said support structure is a rigid material that forms a base and walls of the container.

36. The wrapping container assembly of claim 21 wherein said support structure is cardboard.

37. The wrapping container assembly of claim 21 wherein said support structure has a shock attenuating layer adhered to said support structure inside surface.

38. The wrapping container assembly of claim 21, further comprising reinforcing material adhered to said outer portions of said support structure around said apertures to, so said apertures are reinforced apertures.

39. An assembly used to form a wrapping container for holding an article, comprising:

a flat sheet of flexible wrapping material having a center portion and a plurality of outer portions extending about said center portion, and a plurality of sheet interstitial portions extending between said sheet outer portions, said sheet having an inside surface and an outside surface;

a flat support structure having a center portion, a plurality of outer portions extending outward from said center portion, adjacent ones of said plurality of outer portions having an interstitial space therebetween, said support structure having an inside surface and an outside surface, said support structure being positioned adjacent to said sheet inside surface with said support structure center portion being positioned over said sheet center portion, and said support structure outer portions being positioned over said sheet outer portions with said sheet interstitial portions extending between support structure outer portions across said interstitial spaces, said sheet interstitial portions being out of contact with said flat support structure, each of said support structure outer portions being pivotable relative to said support structure center portion so said support structure outer portions and said sheet outer portions attached thereto can pivot upward to form the container; and a flexible pull cord operatively connected to said sheet outer portion to pivot said support structure outer portions upwardly above said support structure center portion and gather said sheet interstitial portions between said support structure outer portions, upon said pull cord being pulled outwardly from said support structure center portion.

40. The wrapping container assembly of claim 39 wherein said sheet outer portion has at least one aperture with said pull cord extending through said aperture.

41. The wrapping container assembly of claim 40 wherein at least one of said support structure outer portions having at least one aperture therein, said aperture being aligned with said aperture in said sheet outer portion, with said pull cord passing through said aperture in said support structure outer portion.

42. The wrapping container assembly of claim 41, further comprising reinforcing material adhered to said support structure outer portion around said aperture, said reinforcing material having an aperture therein aligned with said aperture in said support structure outer portion, with said pull cord passing through said aperture in said reinforcing material, so said aperture in said outer portion is a reinforced aperture.

43. The wrapping container assembly of claim 39 further including a tubular member secured to said sheet outer portion, said tubular member having an interior passageway that slideably receives said pull cord therein, said tubular member having at least one opening with said pull cord exiting said tubular member through said opening.

44. The wrapping container assembly of claim 39 further including a plurality of loops attached to said sheet outer portion, said plurality of loops each having an interior passageway that slideably receives said pull cord therein.

45. The wrapping container assembly of claim 39, further comprising a second sheet of flexible wrapping material attached to said first sheet outside surface, said second sheet having a second sheet center portion and a second sheet outer portion extending about said second sheet center portion, said second sheet further having at least one aperture extending through said second sheet outer portion, said first and second sheets being attached to form a channel therebetween, said channel having an opening formed by said aperture in said second sheet, said pull cord being slideably retained in said channel and extending through said aperture in said second sheet to form a handle.

46. The wrapping container assembly of claim 39 wherein said sheet outer portion has an edge portion with at least one aperture formed therein, said edge portion being folded back towards said center portion and attached to a portion of said outer portion inward of said edge portion so a channel is formed around said sheet, said channel having an opening formed by said aperture in said outer sheet, said pull chord being slideably disposed in said channel and extending through said opening.

* * * * *